US008967678B2

(12) United States Patent
Rosales et al.

(10) Patent No.: US 8,967,678 B2
(45) Date of Patent: Mar. 3, 2015

(54) MOTOR VEHICLE LOCK

(75) Inventors: David Rosales, Wuppertal (DE); Jens Lueke, Lohmar (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 244 days.

(21) Appl. No.: 13/458,612

(22) Filed: Apr. 27, 2012

(65) Prior Publication Data

US 2012/0274084 A1 Nov. 1, 2012

(30) Foreign Application Priority Data

Apr. 27, 2011 (DE) ..... 20 2011 005 608 U

(51) Int. Cl.

| | |
|---|---|
| ***E05C 3/06*** | (2006.01) |
| ***E05B 15/04*** | (2006.01) |
| ***E05B 17/22*** | (2006.01) |
| ***E05B 47/06*** | (2006.01) |

(52) U.S. Cl.

CPC ..... *E05B 15/04* (2013.01); *E05B 17/22* (2013.01); *E05B 47/06* (2013.01)

USPC ..... 292/196; 292/216; 292/201

(58) Field of Classification Search

USPC ..... 292/196, 216, 201

IPC ..... E05B 81/14,81/15

See application file for complete search history.

(56) References Cited

U.S. PATENT DOCUMENTS

| | | | | |
|---|---|---|---|---|
| 6,655,179 | B2 | 12/2003 | Kobayashi et al. | |
| 7,111,877 | B2 * | 9/2006 | Larsen et al. | 292/216 |
| 7,234,736 | B2 * | 6/2007 | Kachouh | 292/201 |
| 7,261,335 | B2 * | 8/2007 | Schupp | 292/201 |
| 2010/0235058 | A1 | 9/2010 | Papanikolaoau et al. | |

FOREIGN PATENT DOCUMENTS

| | | |
|---|---|---|
| DE | 4421808 | 1/1995 |
| DE | 4433994 | 3/1996 |
| DE | 19627246 | 1/1997 |
| DE | 19632781 | 2/1998 |
| DE | 10361447 | 8/2005 |
| DE | 202004020037 | 3/2006 |
| EP | 1084918 | 3/2001 |
| EP | 1288410 | 3/2003 |
| EP | 2199502 | 6/2010 |
| WO | 2009040074 | 4/2009 |

OTHER PUBLICATIONS

European Search Report, for EP Application No. 12002982.2 mailed Nov. 18, 2014 (12 pages).

* cited by examiner

*Primary Examiner* — Mark Williams

(74) *Attorney, Agent, or Firm* — Pauly, DeVries Smith & Deffner, LLC

(57) ABSTRACT

Described herein is a motor vehicle lock for use in all types of closing elements of a motor vehicle, wherein the motor vehicle lock can be brought into different function states such as "unlocked", "locked", "theft protected" or "child locked." The motor vehicle lock includes a coupling device designed for quick decoupling which includes a coupling arrangement with a shiftable switch element that can be shifted by means of at least one control drive. Depending upon the coupled state, the switch element couples together or decouples two swivelable adjustment elements of the actuating system.

24 Claims, 7 Drawing Sheets

MOTOR VEHICLE LOCK

CROSS-REFERENCE TO RELATED APPLICATIONS

This application claims the benefit of German Patent Application No. DE 20 2011 005 608.2, filed Apr. 27, 2011, the disclosure of which is incorporated by reference herein in its entirety.

FIELD OF THE INVENTION

The invention concerns a motor vehicle lock and a control drive for the motorized adjustment of a switch element. The motor vehicle lock can be used in all types of closing element of a motor vehicle. These include in particular side doors, rear doors, tailgates, boot lids and bonnets. The closing elements can in principle also be designed as a type of sliding door.

BACKGROUND OF THE INVENTION

The known motor vehicle lock (US 2010/0235058 A1) on which the invention is based is fitted with the closing elements of a lock bolt and catch. The lock bolt cooperates in the usual way with a closing bar and is held in a main engagement position or pre-engagement position by the catch in its dropped position.

The known motor vehicle lock is an electric lock with mechanical redundancy. This means the catch is lifted by motor drive by means of an opening auxiliary drive. Also a mechanical actuating system is provided for the catch which, in particular on failure of the power supply, allows manual lifting of the catch via an inside door handle.

The known vehicle lock can be brought into various function states "unlocked", "locked", "theft protected" and "child-locked". In the function state "unlocked", the allocated vehicle door can be opened from the inside and from the outside. In function state "locked" it cannot be opened from the outside but can be opened from the inside. In function state "theft protected", it cannot be opened either from the outside or the inside. In function state "child-locked", it can be opened from the outside but not from the inside.

In the known vehicle lock, the above function states are always stored in a lock controller. As far as the motorised lifting of the catch is concerned, all function states are implemented purely by the controller.

In order in particular to implement the function states "theft protected" and "child-locked" mechanically also in view of the mechanical actuation system of the interior actuating lever, the actuation system in the known vehicle lock provides a coupling device in the widest sense. In coupled state, the actuation system is coupled with the catch to lift it while the actuation system runs freely in decoupled state. From decoupled state a first actuation of the inner actuating lever always causes the coupling of the coupling arrangement. In the presence of the controller function states "theft protected" or "child-locked", the lock controller however causes an immediate reset of the coupling arrangement to the decoupled state so that a second actuation has no effect on the catch. Without this reset, the catch could be lifted manually on the second actuation. In known vehicle locks, manual actuation takes place with a double stroke concept.

Said reset of the coupling arrangement in known vehicle locks is always connected with a shift of the entire mechanical actuation system. To achieve an adequate speed of the above reset, the motorised control drive necessary for this must be designed correspondingly strong, which leads to a very high design cost.

SUMMARY OF THE INVENTION

The invention is based on the problem of structuring and refining the known vehicle lock such that the constructional cost associated with production is reduced.

The problem is solved by a motor vehicle lock with closing elements of a lock bolt and catch, wherein the catch in its dropped position holds the lock bolt in a main engagement position and, where applicable, also in a pre-engagement position, and an actuating lever is provided which in mounted state is allocated to an actuating handle and by its operation the catch can be lifted from the dropped position, wherein the motor vehicle lock can be brought into different function states such as "unlocked", "locked", "theft protected" or "child-locked", wherein the current function state is always stored in a lock controller, and a coupling arrangement is provided by which the actuating lever depending on function state can be coupled with the catch to lift it, wherein from the decoupled state a first actuation of the actuating lever always causes coupling of the coupling arrangement and the lifting of the catch can be achieved by a subsequent second actuation, wherein the lock controller on first actuation transfers the coupling arrangement back to the decoupled state by means of a control drive, depending on current function state, such that the second actuation does not cause lifting of the catch. In one embodiment, the coupling arrangement has a switch element which can be shifted by means of the control drive from a coupling position to a decoupling position and depending on coupled state couples together or decouples two preferably swivelable adjustment elements of the actuating system, in particular the actuating lever and catch or a lever coupled with the catch, and which can be shifted separately from the two adjustment elements at least in the decoupling direction.

In this first teaching the coupling device is designed for fastest possible decoupling. For this the coupling arrangement is fitted with a shiftable switch element which can be shifted by means of at least one control drive. Depending on coupled state, the switch element couples together or decouples two preferably swivelable adjustment elements of the actuating system.

In one embodiment, at least in the decoupling direction, a shift of the switch element is possible separately from the two adjustment elements. Prevention of shifting of the switch element in the decoupling direction by further elements of the actuation system can therefore be largely excluded.

In a second embodiment, which also has independent significance, the coupling arrangement is equipped with a switch element shiftable by means of the control drive. In particular, the motor vehicle lock has closing elements of a lock bolt and catch, wherein the catch in its dropped position holds the lock bolt in a main engagement position and, where applicable, also in a pre-engagement position, wherein an actuating lever is provided which in mounted state is allocated to an actuating handle and by its operation the catch can be lifted from the dropped position, wherein the motor vehicle lock can be brought into different function states such as "unlocked", "locked", "theft protected" or "child-locked", and the current function state is always stored in a lock controller, and a coupling arrangement is provided by which the actuating lever, depending on function state, can be coupled with the catch to lift it, wherein from the decoupled state a first actuation of the actuating lever always causes coupling of the coupling arrangement and the lifting of the catch can be achieved by a subsequent second actuation, wherein the lock controller on first actuation transfers the coupling arrangement back to the decoupled state by means of a control drive, depending on current function state, such that the second actuation does not cause lifting of the catch. In one embodiment, the coupling arrangement has a switch element which can be shifted by means of the control drive from a coupling position to a decoupling position and depending on coupled state couples together or decouples two preferably swivelable adjustment elements of the actuating system, in particular the actuating lever and catch or a lever coupled with the catch, and which can be shifted in a bistable manner between the coupling position and the decoupling position.

In one embodiment, the switch element can be shifted in a bistable manner between the coupling position and the decoupling position. With bistable adjustability of the switch element, the transfer between the coupling position and the decoupling position can be achieved in a constructionally simple manner and with high shift speed with suitable design.

In one embodiment, an opening auxiliary drive s provided for motorised lifting of the catch, preferably the opening auxiliary drive is constructed separately from the control drive. In another embodiment, actuation of the actuating lever is accompanied by an actuating stroke and, where applicable, a return stroke, preferably the actuating stroke of the second actuation follows the return stroke of the first actuation or the actuating stroke of the second actuation follows the actuating stroke of the first actuation. In one embodiment, the actuating lever is designed as an inner actuating lever which in mounted state is coupled with an inner door handle. In another embodiment, after the first actuation of the actuating lever, by means of the control drive, the lock controller decouples the actuating lever, from the catch again if the current function state is "theft protected" or "child-locked".

The setting of coupled states according to the proposal can be achieved constructionally simply with a coupling arrangement that is a coupling connecting link with two laterally adjacent connecting link sections of different height on which the switch element lies to set the decoupling position or coupling position. Here the coupling arrangement has a coupling connecting link which provides a type of movement control for the switch element.

In one embodiment, the actuating lever includes an actuating segment and the catch or the lever coupled with the catch includes an actuating segment, the switch element lying on the decoupling segment of the coupling connecting link lies outside the movement range of at least one of the two actuating segments and the switch element lying on the coupling segment of the coupling connecting link lies within the movement range of both actuating segments so that the actuating lever carries the catch with it, preferably the catch-side actuating segment is designed as part of the coupling connecting link.

In another embodiment, the switch element is pretensioned in the height direction of the coupling connecting link in the coupling segment of the coupling connecting link and the switch element is pretensioned in the side direction of the coupling connecting link in the decoupling segment of the coupling connecting link.

In another embodiment, a shift of the switch element along the coupling connecting link from the decoupling segment to the coupling segment is associated with a dropping of the switch element from the decoupling position in the direction of the coupling position.

In another embodiment, the actuating lever, during the actuating stroke of the first actuation of the switch element, moves along the coupling connecting link from the decoupling segment to the coupling segment, but suppresses a complete dropping of the switch element into the coupling position until an end phase of the return stroke of the first actuation.

In another embodiment, the actuating lever comprises a trigger segment which moves along the coupling connecting link upon actuation of the actuating lever and which comes into engagement with the switch element in the decoupling position on the actuating stroke of the first actuation of the actuating lever and shifts the switch element from the decoupling segment of the coupling connecting link into the coupling segment of the coupling connecting link, whereby the switch element driven by its pretension falls in the direction of the coupling position onto a supporting segment of the actuating lever located higher than the coupling segment of the coupling connecting link and thus preferably comes out of engagement with the coupling connecting link.

In another embodiment, the actuating lever releases the switch element into the coupling position in an end phase of the return stroke of the first actuation.

In another embodiment, the coupling connecting link is arranged on the catch or on a lever coupled with the catch.

In a third embodiment, which also has independent significance, a vehicle lock includes the above coupling arrangement with coupling connecting link without implementing the above double stroke concept. Reference may therefore be made to all statements on the above teachings. In particular, a motor vehicle lock is provided with closing elements of a lock bolt and catch, wherein the catch in its dropped position holds the lock bolt in a main engagement position and, where applicable, in a pre-engagement position, wherein an actuating lever is provided which in mounted state is allocated to an actuating handle and by actuation of which the catch can be lifted from its drop position, and the motor vehicle lock can be brought into various function states such as "unlocked", "locked", "theft protected" or "child-locked" and the current function state is always stored in a lock controller, wherein a coupling arrangement is provided by which the actuating lever, depending on function state, can be coupled with the catch to lift it. In one embodiment, the coupling arrangement comprises a shiftable switch element which, depending on coupled state, couples together or decouples two preferably swivelable adjustment elements of the actuating system and that the coupling arrangement comprises a coupling connecting link with two laterally adjacent connecting link segments of different height on which the switch element lies to set the decoupling position or coupling position.

In additional embodiments, the switch element is a spring elastic flexible wire or strip. The shift of the resulting switch element into the different coupling positions takes place here merely on corresponding bending of the bending switch element. No mounting or guide element is therefore required. In particular, in one embodiment, a motor vehicle lock includes a switch element formed as a spring elastic, flexible wire or strip and can thus be shifted as a switch element between the decoupling position and coupling position. In one embodiment, the switch element is substantially bendable about a geometric bending axis which is oriented substantially perpendicular to the longitudinal extent of at least one part of the switch element, preferably the switch element is formed in the manner of a bending bar. In another embodiment, at least one part of the switch element extends substantially perpendicular to the height direction and substantially perpendicular to the side direction of the coupling connecting link. In another embodiment, a motor vehicle lock includes a switch element designed straight at least in segments, in particular in the engagement region between the adjustment elements to be coupled, preferably that the actuating force runs substantially perpendicular to the extent of the switch element.

The other embodiments concern the equipment of the control drive with at least one rotor vane which slides along the switch element for motorised shifting of the switch element into a deflection position, preferably the decoupling position, and after shifting of the adjustment element into the deflection position, in particular in the decoupling position, executes at least one full revolution. In particular, in one embodiment, the control drive has an output shaft with at least one, preferably two, rotor vane protruding substantially radially from the output shaft which slides along the switch element for motorised shifting of the switch element into a deflection position, in particular the decoupling position, and after shifting of the switch element into the deflection position, in particular the decoupling position, executes at least one complete revolution, preferably several complete revolutions. In another embodiment, upon motorised shifting of the switch element, the rotor vane rotates with a rotation speed of at least 1000 rpm, preferably at least 4000 rpm, further preferably at least 6000 rpm. In another embodiment, the rotor vane includes a radially external rotor edge for engagement with the switch element, preferably wherein the radially external rotor edge extends substantially along the output shaft. In another embodiment, the rotor vane includes an axial switch segment and an axial free running segment and the switch segment has a greater radial extent than the free running segment. In another embodiment, in the deflection position, in particular in the decoupling position, the switch element lies to the side of the switch segment of the rotor vane and is thus out of engagement with the rotor vane. In one embodiment, the control drive includes an electric control drive motor which provides the output shaft of the control drive without intermediate gears.

In equipping the control drive with at least one said rotor vane, it is interesting that a precise positioning of the control drive is not necessary as the rotor vane can "run out" largely arbitrarily. A quite particular advantage results because largely arbitrary rotor speeds can be set as defined braking is also not required. Accordingly in one embodiment, it is proposed that on motorised shifting of the switch element, the rotor vane runs with a rotation speed of at least 1000 rpm.

The control drive with rotor vane is the subject of a fourth embodiment which also has independent significance. Reference may be made to all statements suitable for describing the control drive according to the proposal as such. In particular, one embodiment provides a control drive for motorised adjustment of a switch element of a motor vehicle lock into a deflection position, in particular of a switch element of a motor vehicle lock with an output shaft. In one embodiment, the control drive includes at least one, preferably two, rotor vanes substantially protruding radially from the output shaft which slide along the switch element for motorised shifting of the switch element and after movement of the switch element into the deflection position executes at least one complete revolution, preferably several complete revolutions.

BRIEF DESCRIPTION OF THE FIGURES

The invention is now described in more detail below with reference to merely one embodiment example shown in the drawing. The drawing shows.

DETAILED DESCRIPTION

Figure 1:
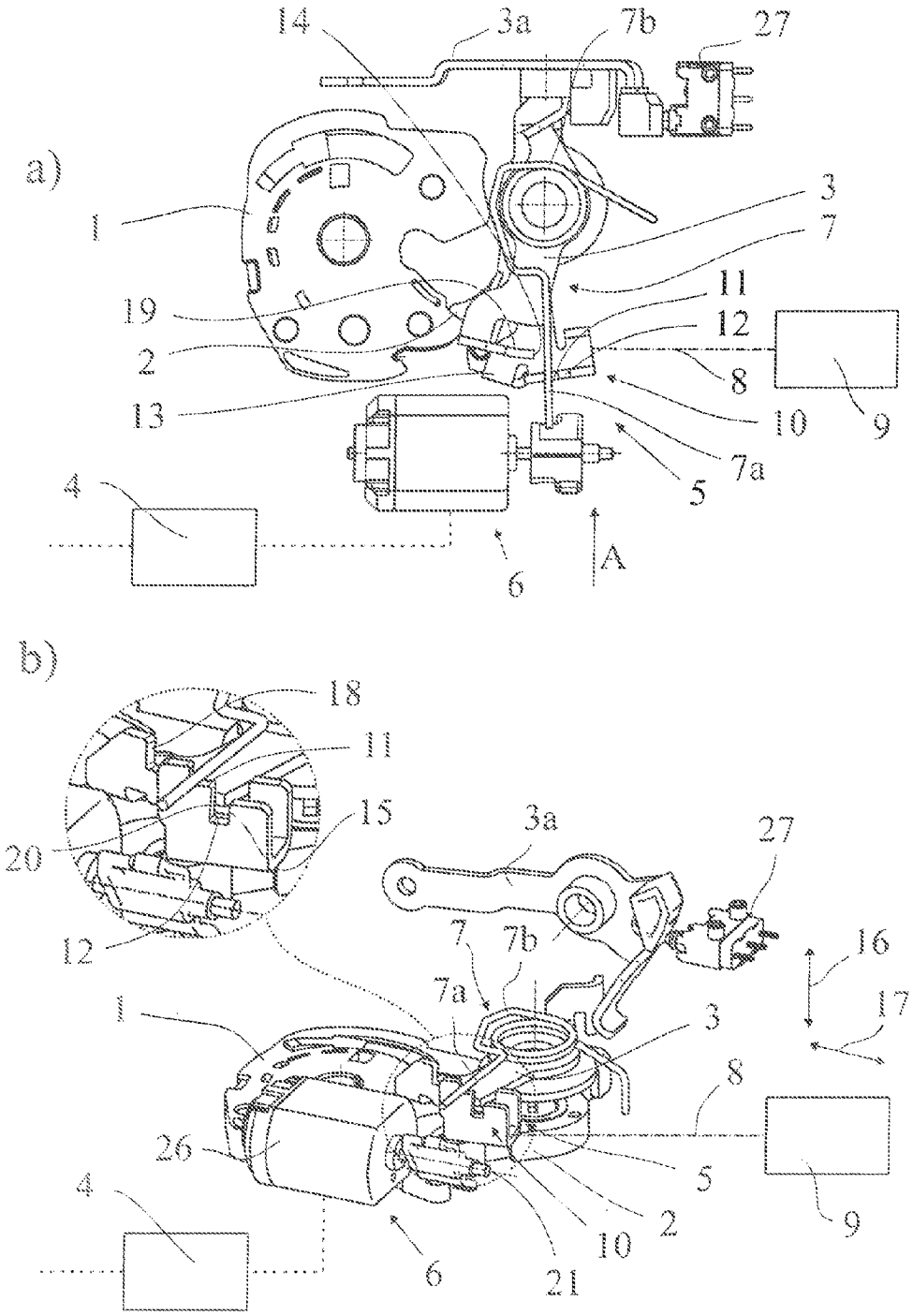
FIG. 1 a motor vehicle lock according to the invention with inner actuating lever not actuated, a) in top view and b) in a perspective view.

It should first be pointed out that the drawing shows only the components of the motor vehicle lock according to the proposal which are necessary to explain the teaching. Accordingly a closing bar which usually cooperates with the lock bolt 1 is not shown in the drawing.

The closing elements of lock bolt 1 and catch 2 also cooperate in the normal manner. The catch 2 in its dropped position holds the lock bolt 1 in a main engagement position as shown for example in FIG. 1. In a motor vehicle lock shown, a pre-engagement position of lock bolt 1 is provided but in the present case this is of no further significance.

Figure 5:
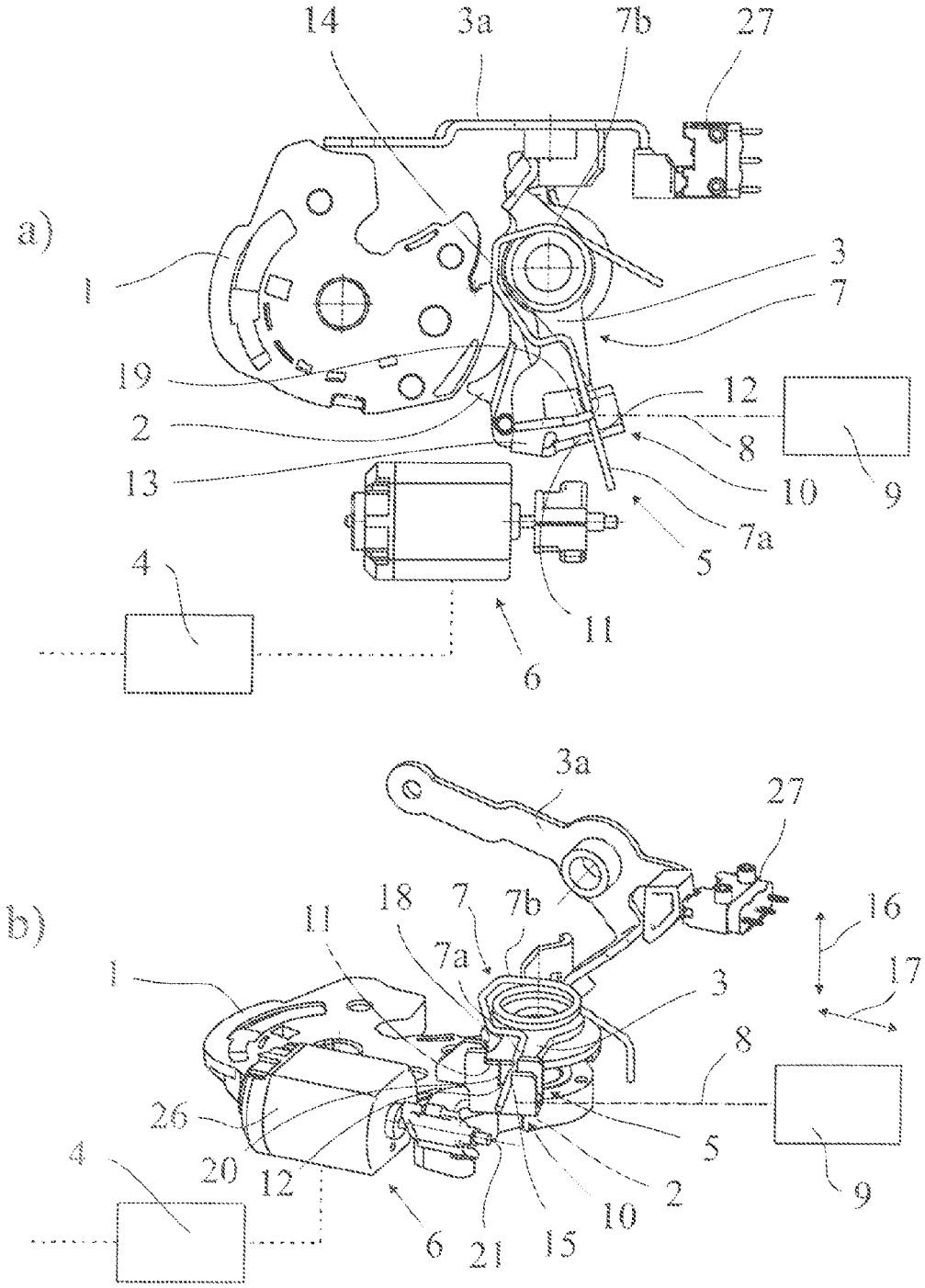
FIG. 5 the motor vehicle lock according to FIG. 1 in the end phase of a second actuation of the inner actuating lever, a) in top view and b) in perspective view.

The catch 2 can be brought into a raised position in which it releases the lock bolt 1 in the direction of its opening position (FIG. 5). The lock bolt 1 thus comes out of engagement with the closing bar or similar, not shown, so that the allocated motor vehicle door or similar can be opened.

The motor vehicle lock has at least one actuating lever 3 which in the mounted state is allocated to an actuating handle, by actuation of which the catch 2 can be lifted from its dropped position. The actuating lever 3 can be an inner actuating lever, an outer actuating lever, an emergency actuating lever or similar.

The motor vehicle lock can be brought into the function states explained in the general part of the description such as "unlocked", "locked", "theft protected" or "child-locked". For the meaning of these function states, reference is made to the statements there.

Figure 2:
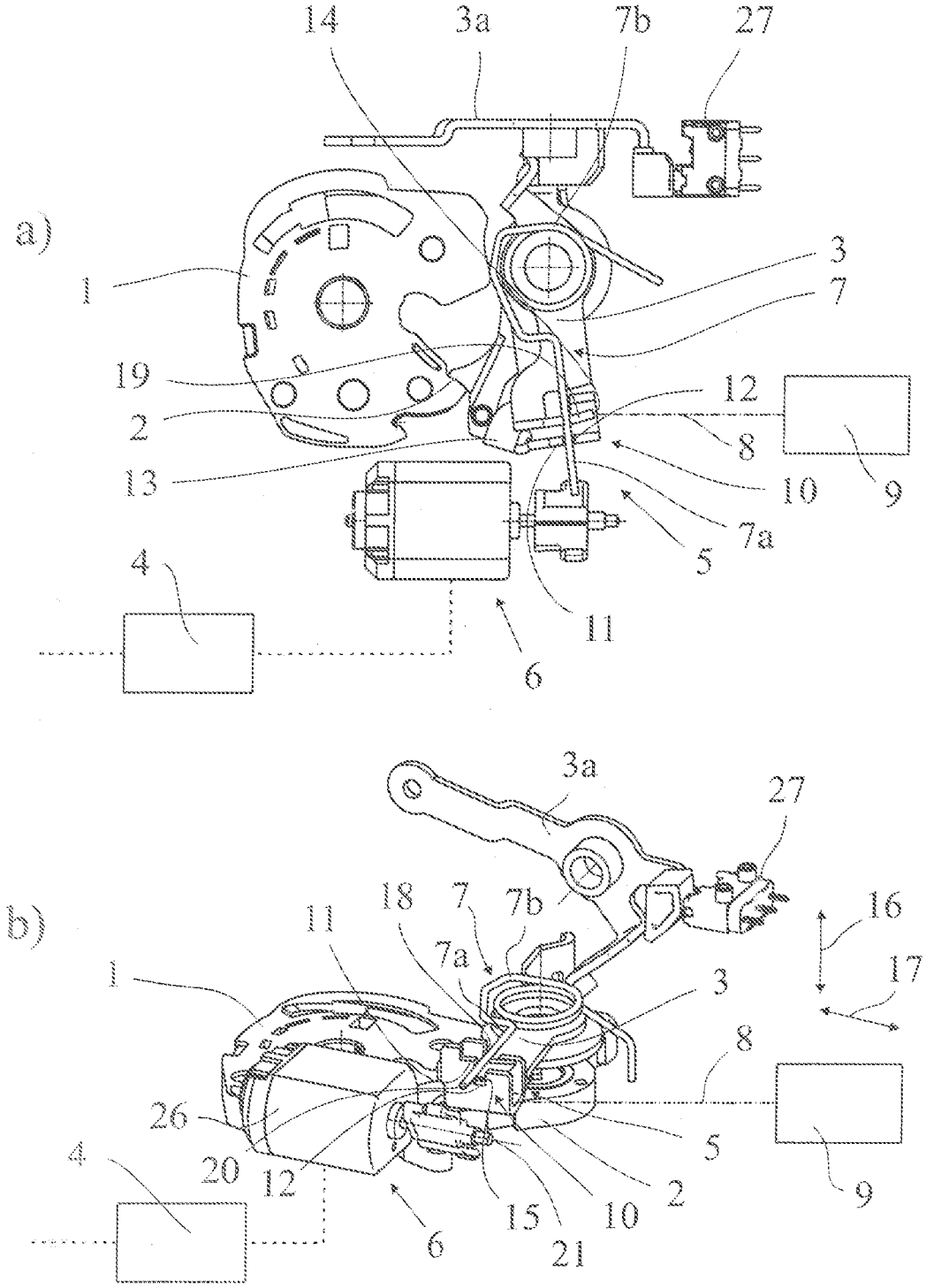
FIG. 2 the motor vehicle lock according to FIG. 1 in the initial phase of the first actuation of the inner actuating lever, a) in top view and b) in perspective view.
Figure 3:
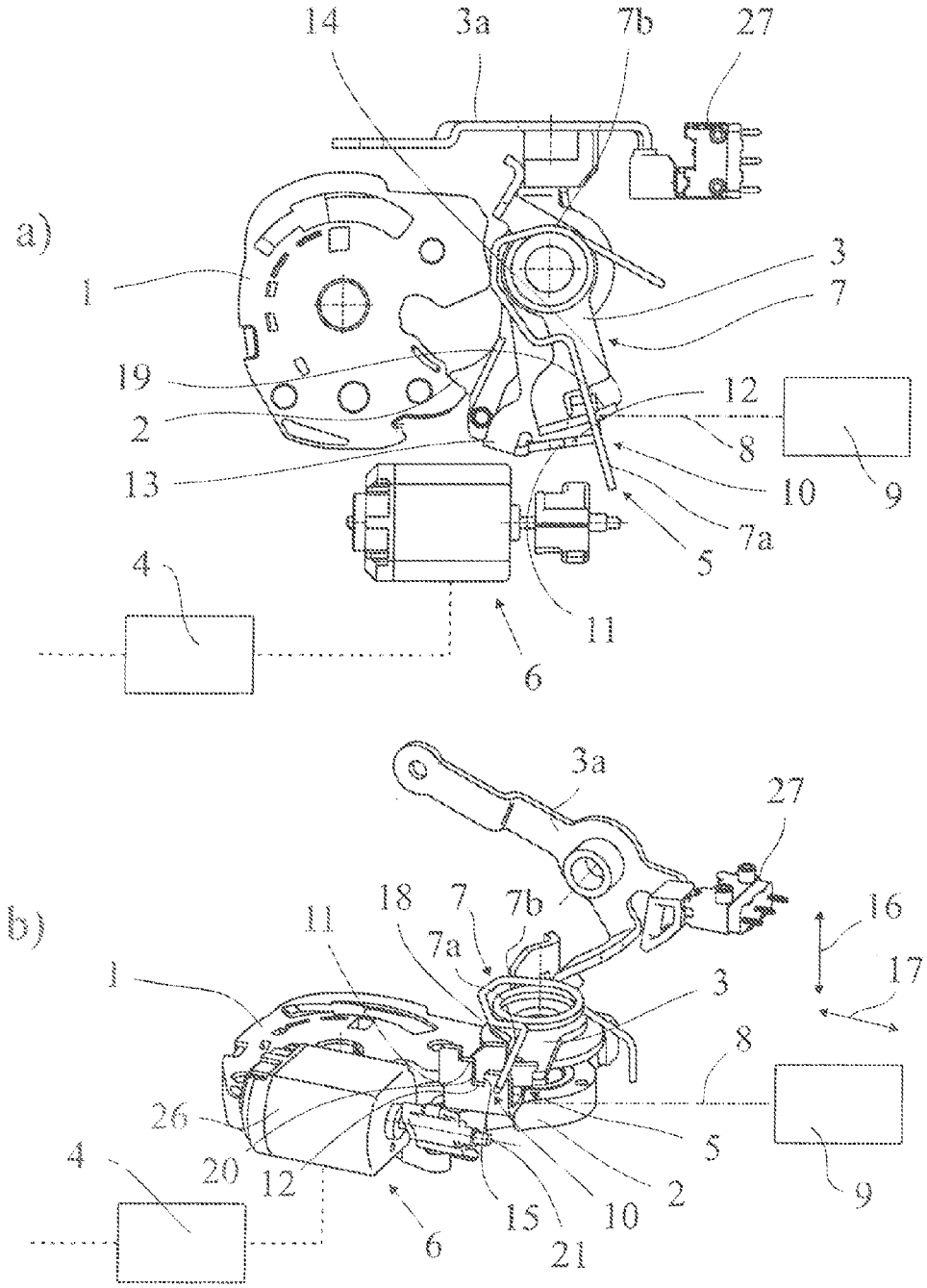
FIG. 3 the motor vehicle lock according to FIG. 1 in the end phase of the first actuation of the inner actuating lever, a) in top view and b) in perspective view.
Figure 4:
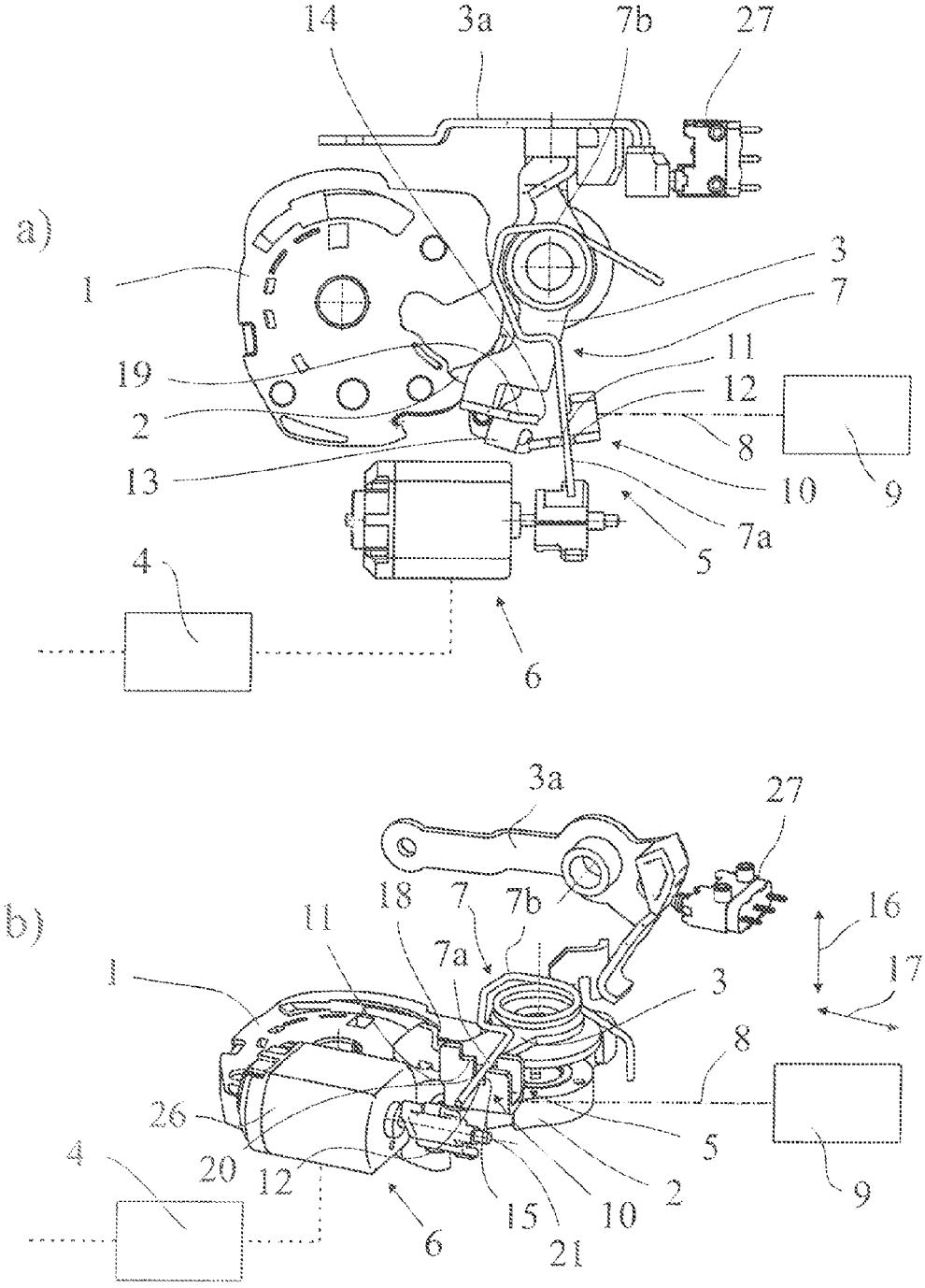
FIG. 4 the motor vehicle lock according to FIG. 1 after completion of the first actuation of the inner actuating lever, a) in top view and b) in perspective view.

A lock controller 4 is allocated to the vehicle lock and serves amongst others to store the current function state. For mechanical implementation of the various function states, a coupling arrangement 5 is provided via which the actuating lever 3, depending on function state, can be coupled with the catch 2 to lift this. FIGS. 1 to 3 show the decoupled state while FIGS. 4 and 5 show the coupled state of the coupling arrangement 5. The function method of the coupling arrangement 5 is explained in more detail below.

It is first essential only that from the decoupled state (FIG. 1), actuation of the actuating lever 3 (FIGS. 2, 3) always causes coupling of the coupling arrangement 5 (FIG. 4). A subsequent second actuation shown in FIG. 5 can then in principle cause the lifting of the catch 2. For this however it is necessary for the lock controller 4 not to have triggered the decoupling of the coupling arrangement 5 on first actuation.

According to the invention namely the lock controller 4, on first actuation, depending on the current function state, transfers the coupling arrangement 5 back to the decoupled state by means of a control drive 6 such that the second actuation does not cause a lifting of the catch 2. This is the case for example if the actuating lever 3 is the inner actuating lever and the current function state "theft protected" or "child-locked" is present in lock controller 4. This too is explained further below.

An essential feature of the proposed solution is the special design of coupling arrangement 5 which comprises a switch element 7 which can be shifted by means of control drive 6 from the coupling position (FIGS. 4, 5) to the decoupling position (FIGS. 1 to 3), which switch element depending on coupled state 2 here couples together or decouples preferably swivelable adjustment elements 3, 13 of the actuating system. The adjustment elements 3, 13 are here preferably firstly the actuating lever 3 and secondly a catch lever 13 connected with the catch 2. In principle any arbitrary lever chain can be arranged between the actuating lever 3 and the catch 2, wherein the adjustment elements can then be any arbitrary, series-connected adjustment elements of this lever chain.

Figure 6:
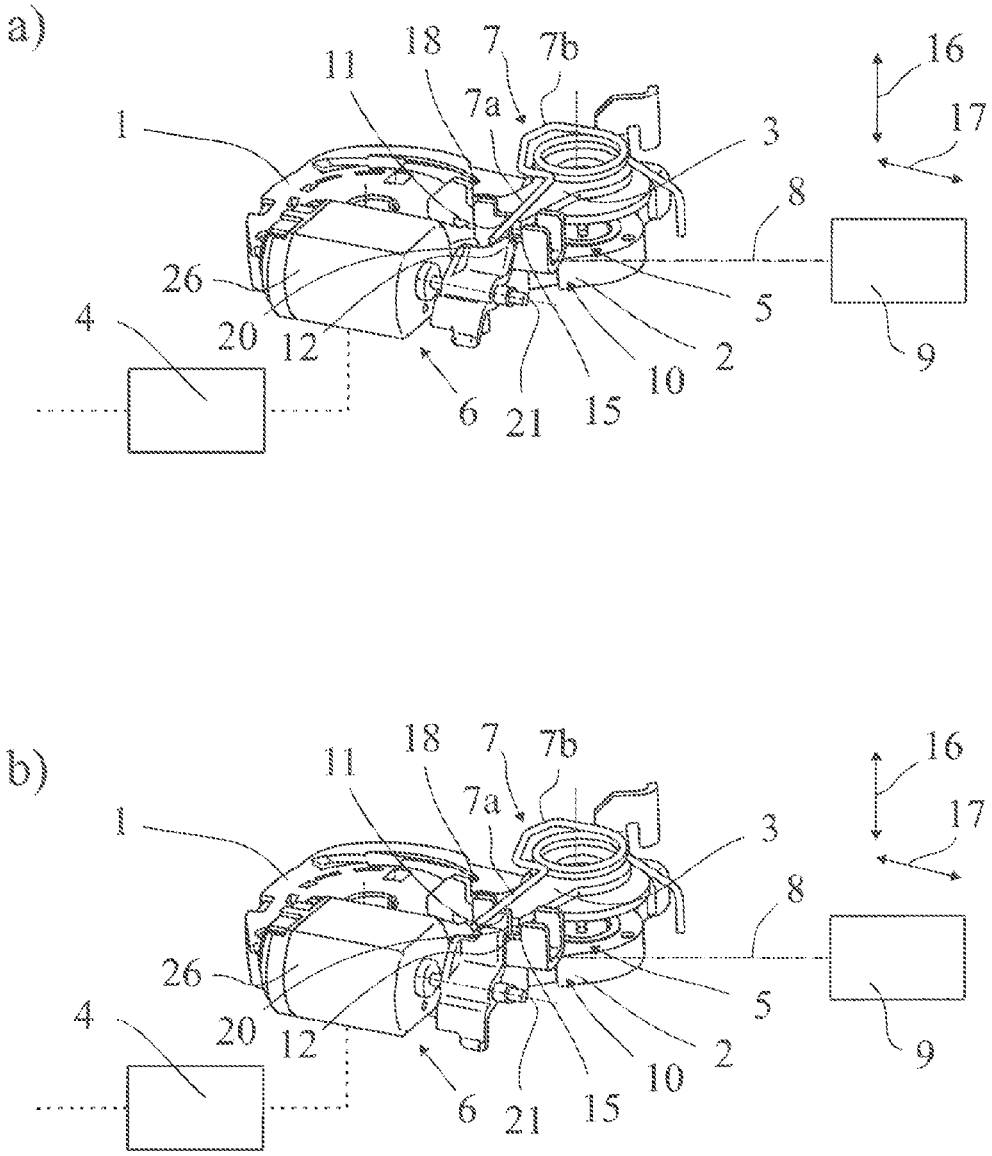
FIG. 6 the motor vehicle lock according to FIG. 1 a) in the initial phase and b) in the end phase of the motorised decoupling of the coupling arrangement, and FIG. 7 the motor vehicle lock according to FIG. 1 in view A.
Figure 7:
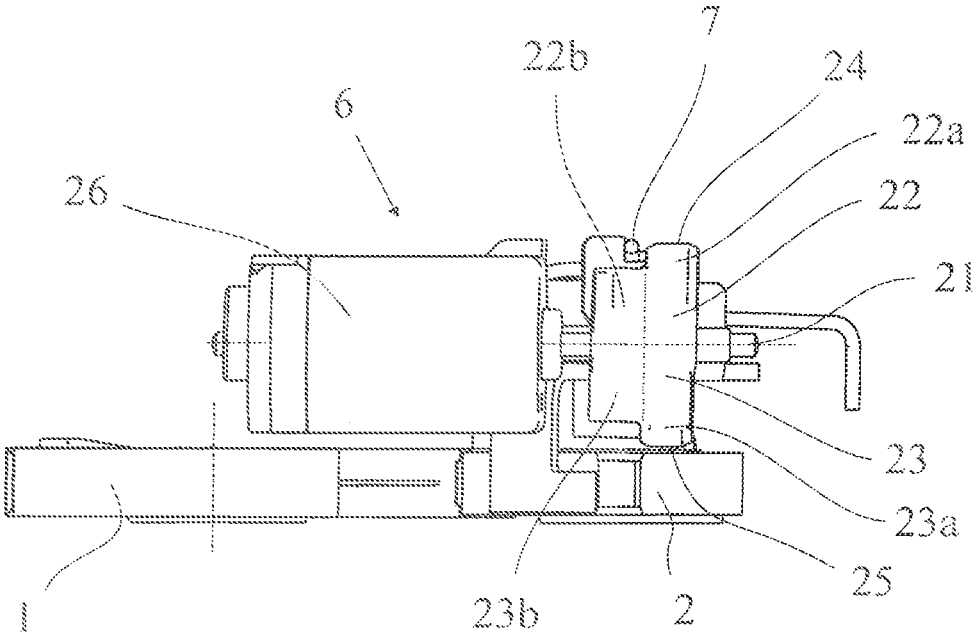

According to the first teaching it is proposed that the switch element 7 can be shifted separately from the two adjustment elements 3, 13 at least in the direction of the decoupling position. This separate adjustability of the switch element 7 arises from a combination of FIGS. 1 and 6. It is clear above all from the depiction according to FIG. 6 that with suitable design, the separate adjustability allows decoupling with particularly low force as there is no or almost no obstruction by the adjustment elements 3, 13.

According to the second teaching it is proposed that the switch element 7 can be shifted in a bistable manner between the coupling position and the decoupling position. The bistable adjustability of the switch element 7 shown is described in the following explanations.

In principle the vehicle lock can be a purely mechanical lock. Here preferably the vehicle lock however is an electric lock with mechanical redundancy. Accordingly an opening auxiliary drive 9 is provided which is coupled with catch 2 via an opening system 8 and serves for motorised lifting of the catch 2. The opening auxiliary drive 9 is merely indicated in the drawing. In the sense of a modular structure, the opening auxiliary drive 9 is constructed preferably separately from the control drive 6.

Actuation of the actuating lever 3 is preferably accompanied by an actuating stroke (FIGS. 1 to 3) and a return stroke (FIG. 3 to FIG. 4). The actuating stroke is here the forward movement, the return stroke the backward movement of the actuating lever 3.

The actuation stroke of the second actuation (FIG. 5) then follows the return stroke of the first actuation. Alternatively however it can also be provided that the actuating stroke of the second actuation directly follows the actuating stroke of the first actuation. In the latter case the first actuation stroke and second actuation stroke together constitute a complete stroke.

Here preferably the actuating lever 3 is an inner actuating lever which in mounted state is coupled to an inner door handle. This was already indicated above. In this case the lock controller 4 decouples the coupling arrangement 5 on first actuation only if the current function state is "theft protected" or "child-locked". Only in these two function states must it be ensured that opening is not possible from the inside either manually or motorised.

In the present case the design of coupling arrangement 5 is of particular significance. The coupling arrangement 5 preferably has a coupling connecting link 10 with two laterally adjacent connecting link sections 11, 12 of different height. The two connecting link sections 11, 12 here together form a step.

To set the decoupling position or coupling position, the switch element 7 lies on the respective connecting link section 11, 12. The connecting link section 11 allocated to the decoupling position is referred to below as the decoupling segment 11, and the connecting link section 12 allocated to the coupling position is referred to as the coupling segment 12. With suitable design of switch element 7, fitting the coupling arrangement 5 with a coupling connecting link 10 leads to particularly simple constructional arrangements. This applies in particular for a switch element 7 made from spring elastic, flexible wire as will be explained below.

The function of the coupling arrangement 5 is based on the fact that the switch element 7 in its coupling position creates a form-fit connection between the actuating lever 3 and the catch 2 or the actuating lever 13 coupled to the catch 2, and in its decoupling position releases this form-fit connection again. Accordingly the actuating lever 3 has an actuating segment 14 and the catch 2 or the catch lever 13 coupled to the catch 2 has an actuating segment 15. In decoupled state, i.e. when the switch element 7 lies on the decoupling segment 11 of the coupling connecting link 10, the switch element 7 is outside the movement range of at least one of the two actuating segments 14, 15, here outside the movement range of both actuating segments 14, 15. In coupled state the switch element 7 lying on the coupling segment 12 of the coupling connecting link 10 lies within the movement range of both actuating segments 14, 15, as a combined view of FIGS. 4 and 5 shows. In the latter case the actuating lever 3 when actuated carries with it the catch 2 in order to lift it.

A particularly compact design arises with the embodiment example shown and to this extent preferred, in that the catch-side actuating segment 15 is designed as part of the coupling connecting link 10.

In the embodiment example shown the spring pretension of switch element 7 is interesting. The switch element 7 is here preferably pretensioned in the height direction 16 of the coupling connecting link 10 in the coupling segment 12 of coupling connecting link 10. In FIG. 1*b*) this is a downward spring pretension.

In addition the switch element 7 is pretensioned in the side direction 17 of the coupling connecting link 10 in the decoupling segment 11 of coupling connecting link 10. This corresponds to pretension of switch element 7 in FIG. 1*b*) substantially to the left.

The step formed by the two coupling segments 11, 12 of the coupling connecting link 10 and the above spring pretension of the switch element 7 cause the switch element 7 to be in a stable state both in its decoupling position (FIG. 1) and in its coupling position (FIG. 4). Thus the abovementioned bistable adjustability of switch element 7 is achieved in a particularly simple manner. The spring pretension is here preferably created by the spring elasticity of switch element 7 itself to be explained below.

The embodiment example depicted and to this extent preferred allows a simple transfer of the coupling arrangement 5 from the decoupled state (FIG. 1) into the coupled state (FIGS. 4, 5). For this it is provided that a shift of the switch element 7 along the coupling connecting link 10 from the decoupling segment 11 to the coupling segment 12 is associated with a dropping of the switch element 7 from the decoupling position in the direction of the coupling position. This is clear from the sequence of FIGS. 1, 2 and 3.

During the actuation stroke of the first actuation of actuating lever 3, the switch element 7 is shifted accordingly along the coupling connecting link 10 from the decoupling segment 11 to the coupling segment 12 (FIGS. 1, 2 and 3), wherein a complete drop of the switch element 7 into the coupling position is however suppressed until an end phase of the return stroke of the first actuation (FIG. 4). This ensures that the first actuation of the actuating lever 3 indeed causes the transfer of the coupling arrangement 5 into the decoupled state. Lifting of the catch 2 however is not yet connected with the first actuation of the actuating lever 3.

In detail, the actuating lever 3 has a trigger segment 18 which on actuation of the actuating lever 3 moves along the coupling connecting link 10 as shown in FIGS. 1 to 3. On the actuation stroke of the first actuation of the actuating lever 3, the trigger segment 18 comes into engagement with the switch element 7 in the decoupling position and shifts the switch element 7 from the decoupling segment 11 into the coupling segment 12 of the coupling connecting link 10. The switch element 7, driven by the pretension mentioned above, falls in the direction of the coupling position onto a supporting segment 19 of actuating lever 3 located higher than the coupling segment 12 of the coupling connecting link 10. This is shown at the transition from FIG. 1 to FIG. 2. Preferably the switch element 7 now comes out of engagement with the coupling connecting link 10 so that the further actuating stroke according to FIG. 3 can take place free of the coupling connecting link 10.

On the subsequent return stroke following the situation shown in FIG. 3, the switch element 7 first follows the movement of the actuating lever 3 and is then, in the end phase of the return stroke of the first actuation, released by the actuating lever 3 into the coupling position. For this a contact segment 20 is provided which retains the switch element 7 in the coupling segment 12 so that the supporting segment 19 slides along the switch element 7 and finally releases the switch element 7 as stated above. The contact segment 20 is here preferably designed as part of the coupling connecting link 10 in the sense of a compact construction.

Various advantageous variants are possible for the arrangement of the coupling connecting link 10. Here preferably the coupling connecting link 10 is arranged on the catch 2, in detail on the catch lever 13 coupled with the catch 2.

For the design of switch element 7 too, different variants are conceivable. In the embodiment example shown and to this extent preferred, the switch element 7 is designed as a spring elastic, flexible wire or strip so that this can shift as a switch element between the decoupling position and the coupling position. A view of FIGS. 1 and 4 together shows the fact that the switch element 7 is substantially bendable about a geometric bending axis which is perpendicular to the longitudinal extent of at least one part of the switch element 7.

In the embodiment example shown and to this extent preferred, the switch element 7 has a straight segment 7*a* and a curved segment 7*b*, wherein the spring elastic bending takes place at least partly in the curved segment 7*b*. In a particularly preferred embodiment the switch element 7 is designed in the form of a bending bar.

Preferably at least part of the switch element 7 runs substantially perpendicular to the height direction 16 and substantially perpendicular to the side direction 17 of the coupling connecting link 10.

It is evident from the drawing that the switch element 7 is here designed straight at least in segments, in particular in the engagement region 7*a* between the adjustment elements 3, 13 to be coupled, wherein the actuation force thus runs substantially perpendicular to the extent of the switch element 7.

A vehicle lock with a coupling arrangement comprising the fundamental structure shown in the drawing with a coupling connecting link 10 is the subject of a third teaching which has independent significance. The above-mentioned double stroke design of actuating lever 2 for lifting the catch is not required for this further teaching.

In the present case particular importance is also paid to the control drive 6 of the motor vehicle lock. The control drive 6 has an output shaft 21 with at least one rotor vane 22, 23 which protrudes substantially radially from the output shaft 21. Here preferably two rotor vanes 22 and 23 are provided which extend substantially in opposing radial directions. The term "radial" here always relates to the output shaft 21.

For motorised shifting of the switch element 7 into a deflection position, here the decoupling position, the rotor vanes 22, 23 slide alternately along the switch element 7. A single sliding of one of the rotor vanes 22, 23 is usually sufficient to move the switch element 7 to the decoupling position. This process can be gathered from the sequence of FIGS. 6*a*) and 6*b*).

It is now essential that after shifting of the switch element 7 into the deflection position, here the decoupling position, at least one full revolution, here preferably several full revolutions, of the rotor vane 22, 23 is completed. In a particularly preferred embodiment it is even provided that the rotor vane 22, 23 on motorised shifting of the switch element 7 runs with a rotation speed of at least 1000 rpm, preferably at least 4000 rpm and further preferably at least 6000 rpm. In a particularly preferred embodiment the rotation speed lies in a range between 5000 rpm and 19,000 rpm, preferably between 8000 rpm and 16,000 rpm.

It is clear here that by the possibility of the rotor vane 22, 23 "running out", the control drive 6 can be controlled for motorised shifting of the switch element 7 at a speed which allows optimum power or torque output. As there is no need to approach a defined end position, a simple time control can be used.

For engagement with the switch element 7, the rotor vanes 22, 23 are preferably each fitted with a radially external rotor edge 24, 25 which extends substantially along the output shaft 21.

An interesting design of rotor vanes 22, 23 is shown in particular in connection with the coupling arrangement 5 according to the proposal. Starting from the coupled state shown in FIG. 5, rotation of the rotor vanes 22, 23 causes a lifting of the switch element 7 until the height of the decoupling segment 11 is reached. By pretension of the switch element 7, the switch element 7 then snaps into the decoupling segment 11.

It is interesting that the rotor vanes 22, 23 each have an axial switch segment 22*a*, 23*a* and an axial free running segment 22*b*, 23*b*, wherein the switch segments 22*a*, 23*a* each have a greater radial extent than the free running segments 22*b*, 23*b*. The free running segments 22*b*, 23*b* are matched to the height of the decoupling segment 11 such that with the switch element 7 lying on the decoupling segment 11, the rotor vanes 22, 23 are free from the switch element 7.

In a particularly preferred embodiment the control drive 6 has an electric control drive motor 26 which provides the output shaft 21 of the control drive 6 without intermediate gears. This takes account of the fact that as explained above, in the preferred embodiment of control drive 6 an optimum power or torque output can be set by corresponding setting of the rotation speed.

The control drive 6 with at least one rotor vane 22, 23 explained above is the subject of a fourth teaching which also has independent significance. Reference can be made to full extent to all statements above directed at the control drive 6.

Reference may also be made to a control feature of the embodiment example shown which is interesting above all in regard to the above double stroke concept. A further actuating lever 3*a* is here connected before actuating lever 3 and in mounted state is coupled via a Bowden cable or similar with an inner door handle or similar, and is here called the "outer actuation lever 3*a*". A switch 27 is now allocated to the outer actuation lever and is electrically coupled with the lock controller 4 (not shown) and can assume three switch states. For example this switch 27 can also be allocated to the actuating lever 3 or another lever of the actuating lever chain.

A first switch state of switch 27 corresponds to the unactuated state as shown in FIG. 1. On first actuation the switch 27 passes through a second switch state shown in FIG. 2 and finally reaches the third switch state shown in FIG. 3. Reaching the third switch state triggers the motorised lifting of the catch 2 by means of the opening auxiliary drive 9, insofar as the corresponding function state is present in the lock controller 4. Reaching the first switch position as part of the return stroke finally triggers the return of the switch element 7 by means of the control drive 6, insofar as again the corresponding function state is present in the lock controller 4.

In the above control system with switch 27, the fact that only a single switch 27 need be provided is particularly advantageous. The second switch state functions to a certain extent as a "spacer" between the first switch state and the third switch state so that it can be ensured that lifting of the catch 2 only takes place when actuating lever 3 is fully deflected.

Finally it should also be pointed out that in addition to the actuating lever 3 described, further actuating levers can be provided. These include for example an external actuating lever which where applicable may be coupled mechanically with the catch 2 via a further coupling arrangement.

What is claimed is:

1. A motor vehicle lock with closing elements of a lock bolt and catch, wherein the catch in a dropped position holds the lock bolt in a main engagement position or in a pre-engagement position, wherein an actuating lever is provided which, in a mounted state, is allocated to an actuating handle and, by the actuating lever's operation, the catch is configured to be lifted from the dropped position, wherein the motor vehicle lock can be brought into different function states such as "unlocked", "locked", "theft protected" or "child-locked", and wherein a current function state for the motor vehicle lock is stored in a lock controller, wherein a coupling arrangement is provided by which the actuating lever, depending on function state, can be coupled with the catch to lift it, wherein from a decoupled state, a first actuation of the actuating lever always causes coupling of the coupling arrangement and lifting of the catch can be achieved by a subsequent second actuation, wherein the lock controller on first actuation transfers the coupling arrangement back to the decoupled state by means of a control drive, depending on current function state, such that the second actuation does not cause lifting of the catch, wherein the coupling arrangement has a switch element which can be shifted by means of the control drive from a coupling position to a decoupling position and depending on coupled state couples together or decouples two swivelable adjustment elements of the actuating system, and which can be shifted separately from the two adjustment elements at least in the decoupling direction or which can be shifted in a bistable manner between the coupling position and the decoupling position;

wherein the switch element is arranged within the transmission chain between the two adjustment elements at least in the coupling position.

2. The motor vehicle lock according to claim 1, wherein an opening auxiliary drive is provided for motorized lifting of the catch.

3. The motor vehicle lock according to claim 1, wherein actuation of the actuating lever is accompanied by an actuating stroke.

4. The motor vehicle lock according claim 1, wherein the actuating lever is designed as an inner actuating lever which in mounted state is coupled with an inner door handle.

5. The motor vehicle lock according to claim 1, wherein after the first actuation of the actuating lever, by means of the control drive, the lock controller decouples the actuating lever from the catch again if the current function state is "theft protected" or "child-locked".

6. The motor vehicle lock according to claim 1, wherein the coupling arrangement is a coupling connecting link with two laterally adjacent connecting link sections of different height on which the switch element lies to set the decoupling position or coupling position.

7. The motor vehicle lock according to claim 6, wherein the actuating lever comprises an actuating segment and the catch or the lever coupled with the catch comprises an actuating segment, wherein the switch element lying on the decoupling segment of the coupling connecting link lies outside the movement range of at least one of the two actuating segments and the switch element lying on the coupling segment of the coupling connecting link lies within the movement range of both actuating segments so that the actuating lever carries the catch with it.

8. The motor vehicle lock according to claim 6, wherein the switch element is pretensioned in the height direction of the coupling connecting link in the coupling segment of the coupling connecting link and the switch element is pretensioned in the side direction of the coupling connecting link in the decoupling segment of the coupling connecting link.

9. The motor vehicle lock according to claim 6, wherein a shift of the switch element along the coupling connecting link from the decoupling segment to the coupling segment is associated with a dropping of the switch element from the decoupling position in the direction of the coupling position.

10. The motor vehicle lock according to claim 6, wherein the actuating lever, during the actuating stroke of the first actuation of the switch element, moves along the coupling connecting link from the decoupling segment to the coupling segment, but suppresses a complete dropping of the switch element into the coupling position until an end phase of the return stroke of the first actuation.

11. The motor vehicle lock according to claim 6, wherein the actuating lever comprises a trigger segment which moves along the coupling connecting link upon actuation of the actuating lever and which comes into engagement with the switch element in the decoupling position upon the actuating stroke of the first actuation of the actuating lever and shifts the switch element from the decoupling segment of the coupling connecting link into the coupling segment of the coupling connecting link, whereby the switch element driven by its pretension falls in the direction of the coupling position onto a supporting segment of the actuating lever located higher than the coupling segment of the coupling connecting link and thus comes out of engagement with the coupling connecting link.

12. The motor vehicle lock according to claim 6, wherein the actuating lever releases the switch element into the coupling position in an end phase of the return stroke of the first actuation.

13. The motor vehicle lock according to claim 1, wherein the coupling connecting link is arranged on the catch or on a lever coupled with the catch.

14. The motor vehicle lock according to claim 1, wherein the switch element is formed as a spring elastic, flexible wire or strip and can be shifted as a switch element between the decoupling position and coupling position.

15. The motor vehicle lock according to claim 14, wherein the switch element is substantially bendable about a geometric bending axis which is oriented substantially perpendicular to the longitudinal extent of at least one part of the switch element.

16. The motor vehicle lock according to claim 14, wherein at least one part of the switch element extends substantially perpendicular to the height direction and substantially perpendicular to the side direction of the coupling connecting link.

17. The motor vehicle lock according to claim 14, wherein the switch element is designed straight at least in segments in the engagement region between the adjustment elements to be coupled, wherein the actuating force runs substantially perpendicular to the extent of the switch element.

18. The motor vehicle lock according to claim 1, wherein the control drive has an output shaft with at least one rotor vane protruding substantially radially from the output shaft which slides along the switch element for motorized shifting of the switch element into a deflection position and after shifting of the switch element into the deflection position, executes at least one complete revolution.

19. The motor vehicle lock according to claim 18, wherein, upon motorized shifting of the switch element, the rotor vane rotates with a rotation speed of at least 1000 rpm.

20. The motor vehicle lock according to claim 18, wherein the rotor vane comprises a radially external rotor edge for engagement with the switch element, wherein the radially external rotor edge extends substantially along the output shaft.

21. The motor vehicle lock according to claim 18, wherein the rotor vane comprises an axial switch segment and an axial free running segment and the switch segment has a greater radial extent than the free running segment.

22. The motor vehicle lock according to claim 18, wherein, in a deflection position, the switch element lies to the side of the switch segment of the rotor vane and is out of engagement with the rotor vane.

23. The motor vehicle lock according to claim 1, wherein the control drive comprises an electric control drive motor which provides the output shaft of the control drive without intermediate gears.

24. A motor vehicle lock with closing elements of a lock bolt and catch, wherein the catch in its a dropped position holds the lock bolt in a main engagement position or in a pre-engagement position, wherein an actuating lever is provided, which in a mounted state, is allocated to an actuating handle and by actuation of which the catch can be lifted from its dropped position, wherein the motor vehicle lock can be brought into various function states comprising "unlocked", "locked", "theft protected" or "child-locked" and wherein the current function state for the motor vehicle lock is stored in a lock controller, wherein a coupling arrangement is provided by which the actuating lever, depending upon function state, can be coupled with the catch to lift it, wherein the coupling arrangement comprises a shiftable switch element which, depending upon coupled state, couples together or decouples two swivelable adjustment elements of the actuating system and the coupling arrangement comprises a coupling connecting link with two laterally adjacent connecting link segments of different height on which the switch element lies to set the decoupling position or coupling position;

wherein the switch element is arranged within the transmission chain between the two adjustment elements at least in the coupling position.

* * * * *

UNITED STATES PATENT AND TRADEMARK OFFICE

CERTIFICATE OF CORRECTION

PATENT NO. : 8,967,678 B2
APPLICATION NO. : 13/458612
DATED : March 3, 2015
INVENTOR(S) : David Rosales and Jens Lueke It is certified that error appears in the above-identified patent and that said Letters Patent is hereby corrected as shown below:

Claims

Column 14, line 12, claim 24, 'its' should be omitted.

Signed and Sealed this
Eighth Day of December, 2015

Michelle K. Lee

Michelle K. Lee
*Director of the United States Patent and Trademark Office*